US006688869B1

(12) United States Patent
Simonds

(10) Patent No.: US 6,688,869 B1
(45) Date of Patent: Feb. 10, 2004

(54) EXTENSIBLE VANE MOTOR

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 0 days.

(21) Appl. No.: 10/242,342

(22) Filed: Sep. 11, 2002

(51) Int. Cl.[7] ..... F01C 1/00

(52) U.S. Cl. ..... 418/241; 418/137; 418/138; 418/253; 418/265

(58) Field of Search ..... 418/241, 253, 418/265, 138, 137

(56) References Cited

U.S. PATENT DOCUMENTS

| | | | | | |
|---|---|---|---|---|---|
| 1,115,470 | A | | 10/1914 | Lipman | |
| 1,417,003 | A | * | 5/1922 | Watkins | 418/134 |
| 1,492,456 | A | | 4/1924 | Hansen-Ellehammer | |
| 1,686,505 | A | * | 10/1928 | Stastny | 418/138 |
| 2,295,117 | A | | 9/1942 | Koester | |
| 2,463,155 | A | | 3/1949 | Dawes | |
| 2,636,480 | A | | 4/1953 | Becker | |
| 2,671,411 | A | * | 3/1954 | Rhine | 418/254 |
| 2,799,371 | A | | 7/1957 | Osborn | |
| 3,368,537 | A | | 2/1968 | Antonio | |
| 3,455,245 | A | | 7/1969 | Reichling | |
| 3,457,872 | A | * | 7/1969 | Potts | 418/241 |
| 3,787,150 | A | | 1/1974 | Sarich | |
| 3,804,562 | A | | 4/1974 | Hansson | |
| 3,812,828 | A | | 5/1974 | Griffiths | |
| 3,828,555 | A | | 8/1974 | Capdevielle | |
| 3,938,426 | A | | 2/1976 | Hunter | |
| 3,988,083 | A | | 10/1976 | Shimizu et al. | |
| 3,989,426 | A | | 11/1976 | Sato et al. | |
| 4,241,713 | A | | 12/1980 | Crutchfield | |
| 4,712,789 | A | | 12/1987 | Brilando | |
| 4,757,988 | A | | 7/1988 | Szymski | |
| 4,789,317 | A | | 12/1988 | Waser et al. | |
| 4,898,524 | A | | 2/1990 | Butzen | |
| 4,902,001 | A | | 2/1990 | Balbo | |
| 4,986,402 | A | | 1/1991 | Neuwirth | |
| 4,998,868 | A | | 3/1991 | Sakamaki et al. | |
| 5,002,473 | A | | 3/1991 | Sakamaki et al. | |
| 5,011,390 | A | | 4/1991 | Sakamaki et al. | |
| 5,030,074 | A | | 7/1991 | Sakamaki et al. | |
| 5,238,373 | A | * | 8/1993 | Lew et al. | 418/137 |
| 5,269,668 | A | * | 12/1993 | Lew et al. | 418/241 |
| 5,284,427 | A | | 2/1994 | Wacker | |
| 5,461,863 | A | | 10/1995 | Simonds | |
| 5,533,566 | A | | 7/1996 | Fineblum | |
| 5,551,854 | A | | 9/1996 | Edwards | |
| 5,617,936 | A | | 4/1997 | Nemoto | |
| 5,816,789 | A | | 10/1998 | Johnson | |
| 5,961,310 | A | | 10/1999 | McClure | |
| 5,967,016 | A | | 10/1999 | Simonds | |
| 5,974,943 | A | | 11/1999 | Simonds | |
| 6,024,549 | A | | 2/2000 | Lee | |
| 6,203,041 | B1 | | 3/2001 | Helm | |
| 6,453,793 | B1 | | 9/2002 | Simonds | |

FOREIGN PATENT DOCUMENTS

| | | | | |
|---|---|---|---|---|
| AT | 141416 A | * | 12/1934 | F01C/1/04 |
| DE | 2029 280 | | 6/1970 | |
| DE | 3219757 A | * | 12/1983 | F01C/1/34 |
| DE | 4341394 A | | 4/1994 | |
| FR | 2169500 A | | 9/1973 | |

(List continued on next page.)

*Primary Examiner*—Thomas Denion
*Assistant Examiner*—Theresa Trieu
(74) *Attorney, Agent, or Firm*—Brett J. Trout

(57) ABSTRACT

A motor for converting fluid pressure to rotational motivation and pump for moving fluid, comprising a first drum provided within a second drum. The first drum is provided with a pair of vanes, each provided with a generally heart-shaped slot around a drum shaft. The orientation of the drum shaft and shape of the slots cause the vanes to extend and retract relative to the inner drum as fluid pressure or mechanical motion rotate the inner drum relative to the outer drum.

23 Claims, 11 Drawing Sheets

FOREIGN PATENT DOCUMENTS

| | | | | | |
|---|---|---|---|---|---|
| GB | 392999 | | | 6/1933 | |
| GB | 743 088 | A | | 1/1956 | |
| GB | 2075601 | A | * | 11/1981 | ..... F01C/1/04 |
| JP | 61-83492 | A | | 9/1984 | |
| JP | 01-290924 | A | | 5/1988 | |
| WO | WO 82701215 | | | 4/1982 | |
| WO | WO 02/101203 | A1 | * | 12/2002 | ..... F01C/1/04 |

* cited by examiner

EXTENSIBLE VANE MOTOR

BACKGROUND OF THE INVENTION

1. Field of the Invention

The present invention relates in general to a vane motor for converting fluid pressure to rotational motivation, and capable of pumping fluid when rotational motivation is applied to the motor and, more specifically, to a vane motor with pumping capabilities utilizing two vanes configured to extend a predetermined distance during a push cycle and retract a predetermined distance during a return cycle.

2. Description of the Prior Art

Motors for converting fluid pressure to rotational motivation are generally known in the art. Two types of such motors are the turbine motor and the vane motor. A turbine motor includes a circular shell, having an inlet on its circumference and an exhaust at its center. A plurality of radially-extending, curved fins is provided within the shell. Pressurized fluid is provided into the shell through the inlet. The pressurized fluid pushes outward against the curved fins to rotate the fins before exiting through the exhaust port at the center of the circular shell.

One drawback of turbine motors is the high operating speeds typically required to develop sufficient torque. High operating speeds also make turbin motors susceptible to contamination. If particulate matter enters a turbine motor, the vanes of the turbine motor strike the particulate matter at high speed, causing damage to the vanes. Due to the high speed, even very small particulate matter can erode or destroy a vane. An additional drawback of the turbine motor is its inefficiency at low speeds. Turbine motors typically cannot start against an applied load. If a load were applied to a turbine motor before the vanes began to rotate, pressurized fluid applied through the inlet would simply exit directly out the exhaust port without rotating the vanes. Additionally, turbine motors are incapable of generating reverse rotational motion. If fluid were provided to the motor in a reverse direction, the vanes would still rotate in the same direction. Accordingly, a transmission is required to operate turbine motors efficiently at various speeds and reversing gears are required to generate reverse torque using a turbine motor.

Like a turbine motor, a vane motor has a plurality of radially-extending vanes. Unlike a turbine motor, however, the vanes of a vane motor are straight and extensible in relation to a center cylinder. The vanes of a vane motor are received in slots provided in the center cylinder. The vanes and center cylinder are provided within an elliptical shell. Fluid is supplied into the shell through a fluid input provided along the circumference of the shell. The fluid presses against the vanes and propels the center cylinder before exiting from an exhaust also provided along the circumference of the shell. Rotation of the center cylinder throws the vanes outward against the interior walls of the shell. Since the exterior shell is elliptical, and the vanes extend to the exterior shell, more of the vanes are exposed as the vanes pass the drive side of the exterior shell than is exposed as the vanes pass the recovery side of the exterior shell.

As the vanes pass by the drive side of the shell, the walls of the shell force the vanes into the slots. Conversely, as the vanes pass the recovery side of the shell, the vanes are thrown outward to their full extension. This extension and retraction of the vanes reduces the exposed surface area of the vanes to reduce undesired counter thrust. The vanes are, however, at least partially extended throughout the rotation.

A certain portion of the fluid, therefore, presses against the vanes, imparting undesired counter force. Accordingly, a certain amount of fluid pressure goes toward applying force to the vanes in the reverse direction. Not only is this counter force unavailable to drive the vanes in the desired direction, but the counter force makes driving the vanes more difficult.

Accordingly, vane motors are a relatively inefficient conversion of fluid pressure to rotational motion. Additionally, the vanes rub against the exterior shell, reducing the lifespan of the vanes and typically requiring continuous lubrication. Operating vane motor at high speeds will often reduce the lifespan of the vanes even further. Although vane motors can produce torque at low speeds, unlike turbine motors, vane motors have a relatively narrow band of fluid pressures over which the most efficient torque is obtained. Due to this narrow band of efficiency, vane motors also must be used in conjunction with a transmission to obtain efficient rotational motion at multiple shaft speeds.

Prior art fluid pressure rotational motors typically have an outer shell containing a plurality of vanes rotating about an axis at the center of the shell. Due to their design, prior art motors have numerous unique disadvantages, as well as the common disadvantages of inefficiency of operation and a narrow band of fluid pressures over which the most efficient torque is produced.

It is also known in the art to provide a rotary pump having an interior drum containing vanes coupled by lost motion linkage around an axis and the entire apparatus provided within an outer drum. Such a pump is described in U.S. Pat. No. 2,674,411. As the inner drum rotates, the lost motion linkages extend and retract the vanes relative to the inner drum, extending the vanes during the push cycle and retracting the vanes on the return cycle. A drawback associated with such prior art designs is the geometry associated with such an arrangement. In such an arrangement, the geometry of the lost motion linkages constantly extends or retracts the vanes as the inner drum is rotating. Accordingly, the vanes only reach their maximum extension and maximum retraction at one singular point along their rotation. Since the vanes extend toward their maximum extension and retract immediately after passing the maximum extension point, the distance between the inner drum and outer drum must increase toward the maximum extension point and decrease thereafter. This geometry leads to a narrowing of the ingress and egress point of the fluid into and out of the push chamber. This narrowing not only restricts flow of the fluid, but as the chamber expands, the flow of the fluid slows, reducing the power imparted to the vane. Similarly, as the vane passes its maximum extension point, the push chamber again narrows, increasing the speed of the fluid flow, but restricting its power. This expansion and restriction in the push chamber reduces the efficiency and increases the wear associated with such motors. It would be desirable to produce a motor which had a push chamber of consistent dimensions to eliminate the drawbacks described herein. Such a device would also include means for maintaining the vanes at maximum extension relative to the inner drum throughout the entire time the vane remains in the push chamber.

It would be desirable to provide a fluid motor with an efficient production of torque over a wide range of fluid pressures, to provide not only a stable rotational torque, but also to eliminate the need for a transmission and a reverse gear. It would also be desirable to provide a long-wearing motor capable of withstanding vane contact with small amounts of particulate matter. The difficulties encountered in the prior art discussed hereinabove are substantially eliminated by the present invention.

SUMMARY OF THE INVENTION

In an advantage provided by this invention, a fluid motor produces torque over a wide range of fluid pressures.

Advantageously, this invention provides an efficient conversion of fluid pressure to rotational motivation.

Advantageously, this invention provides a long wearing fluid motor of low cost construction.

Advantageously, this invention provides a fluid motor capable of operating with particulate matter provided within a driving fluid.

Advantageously, this invention provides a fluid motor with a reduced number of wear points.

Advantageously, this invention provides an efficient conversion of rotational motivation to fluid movement.

Advantageously, in a preferred example of this invention, a motor is provided, comprising an inner race provided within an outer race. Means are coupled to the inner race for centering the inner race on a first axis as it rotates. A shaft is provided along a second axis different than the first axis. A vane is coupled to the shaft and means are coupled to the vane for moving an end of the vane arcuately relative to the shaft.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
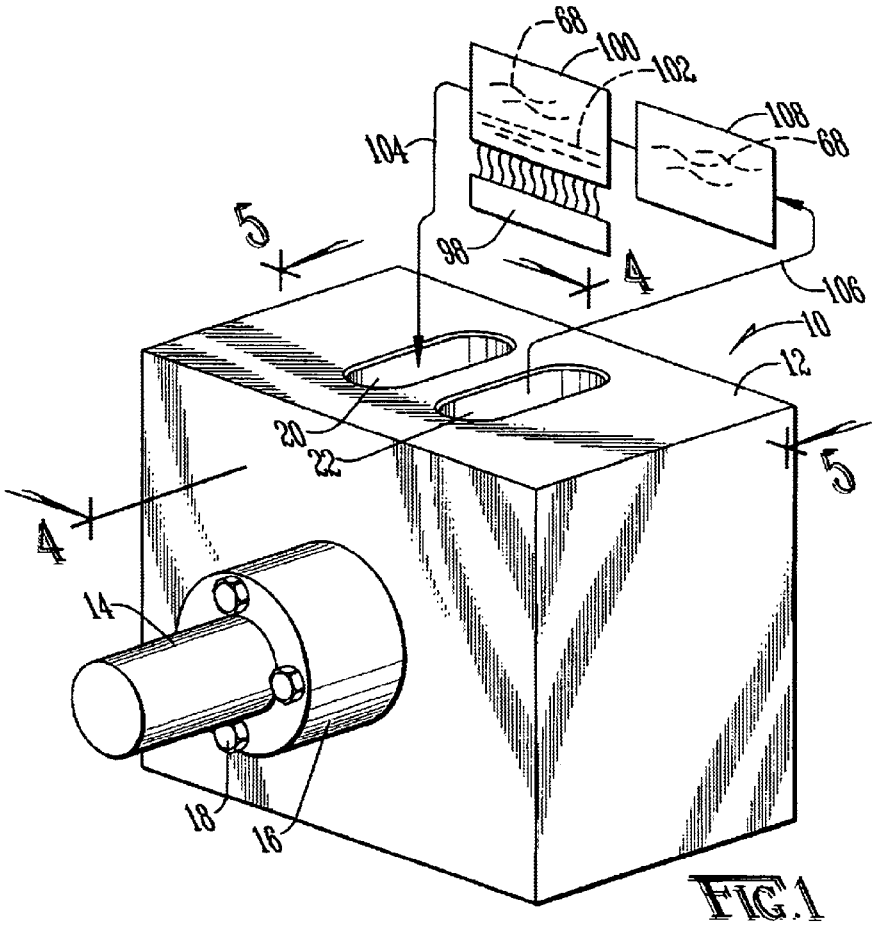
FIG. 1 illustrates an example perspective view of a motor according to this invention.
Figure 2:
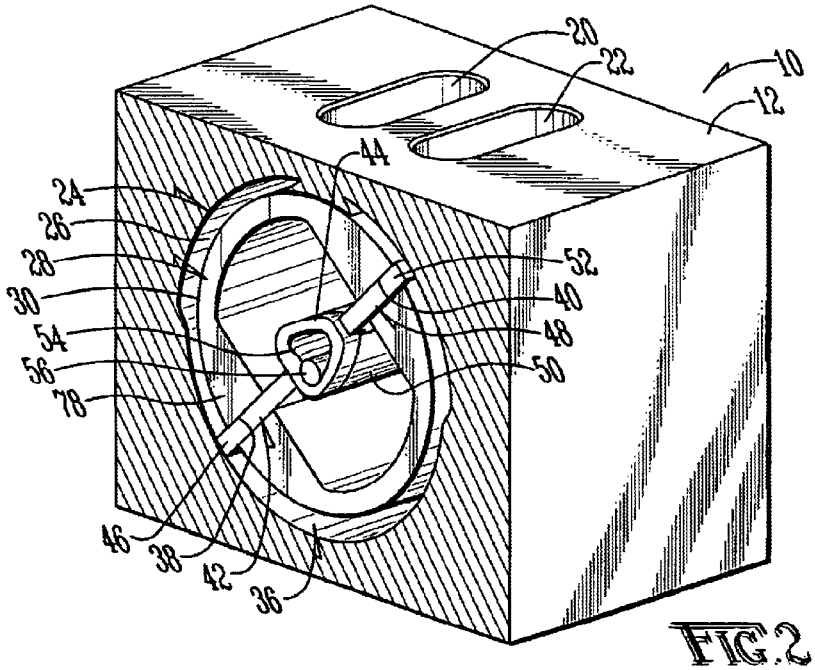
FIG. 2 illustrates a rear perspective view of the motor of FIG. 1, shown with the rear of the case and the shaft bushings removed.

Referring to FIG. 1, a motor (10) according to this invention is shown with a drive shaft (14) coupled to a casing (12) by a bushing (16). The bushing (16), in turn, is secured to the casing (12) by bolts (18). As shown in FIG. 2, the casing (12) is provided with a fluid inlet (20) and a fluid outlet (22). The casing (12) is provided with a hollow interior (24) in fluid communication with the inlet (20) and outlet (22). The hollow interior (24) is defined by an outer race (26). Provided within the hollow interior (24) is an inner drum (28), which comprises a front plate (32), back plate (34), and a cylindrical inner race (30). (FIGS. 2 and 4).

As shown in FIG. 2, the inner race (30) and outer race (26) define an interstice (36) of a constant height along approximately 90 to 270, and preferably about approximately 180 degrees of the surface of the outer race (26) facing the inner race (30). As shown, the inner race (30) is provided with a first aperture (38) and a second aperture (40). Provided within the inner drum (28) is a first vane assembly (42), which includes a first block (44) and a first vane (46). Also provided within the inner drum (28) is a second vane assembly (48), comprising a second block (50) and a second vane (52). The blocks (44) and (50) are provided with a generally rounded, heart-shaped slot (54). Passing through the slots (54) is a stainless steel drum shaft (56).

Figure 3:
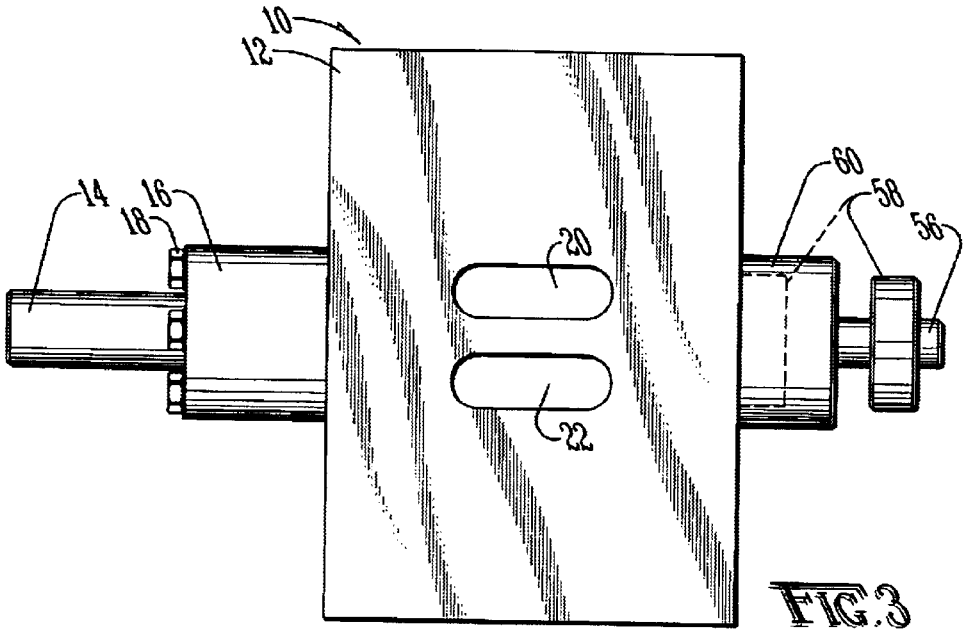
FIG. 3 illustrates a top plan view in partial phantom of the motor of FIG. 1.

As shown in FIG. 3, provided around the drum shaft (56) are a pair of bearings (58), such as those well known in the art, secured to a pair of support brackets (60)(only one shown). As can be seen in FIG. 4, the drive shaft (14) is positioned slightly higher than the drum shaft (56). The drive shaft (14) is centered on the front plate (32) and welded and secured thereto by a locking collar (62). Accordingly, the drive shaft (14) is parallel to, but on a different axis than the drum shaft (56). Since the shafts (14) and (56) each rotate on a different axis, the back plate (34) must be provided with a large circular aperture (64), into which is secured a bearing (66). The bearing (66) supports the inner drum (28) against the casing (12) and allows the drum shaft (56) to extend out of the casing (12) and rotate on its own axis. The bearing (66) also maintains a substantially fluid tight seal to prevent the escape of pressurized fluid (68) out of the casing (12).

Figure 4:
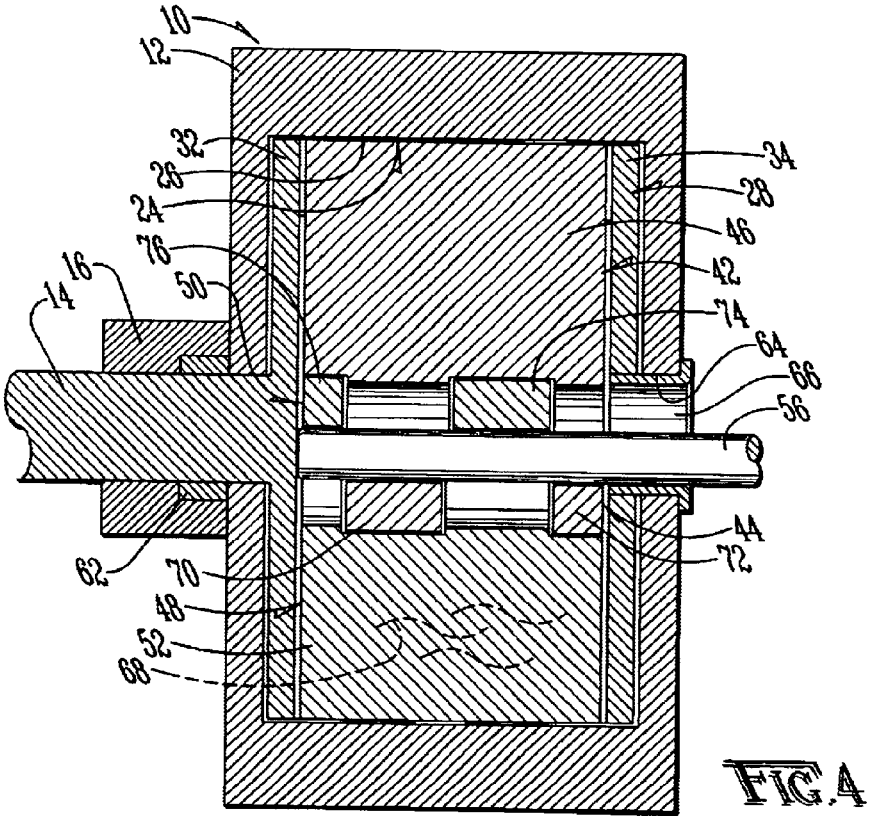
FIG. 4 illustrates a side elevation cross-section of the motor taken along line 4—4 of FIG. 1, shown with the vanes in maximum extension and maximum retraction orientation.

As shown in FIG. 4, the first vane assembly (42) has the first block (44) divided into a first leg (70) and a smaller second leg (72). Similarly, the second block (50) of the second vane assembly (48) is divided into a first leg (74) and a smaller second leg (76). As shown, the legs (70–76) are staggered along the drum shaft (56) to evenly support the legs (70–76) on the drum shaft (56) in an equal, but mirrored, orientation.

Figure 5:
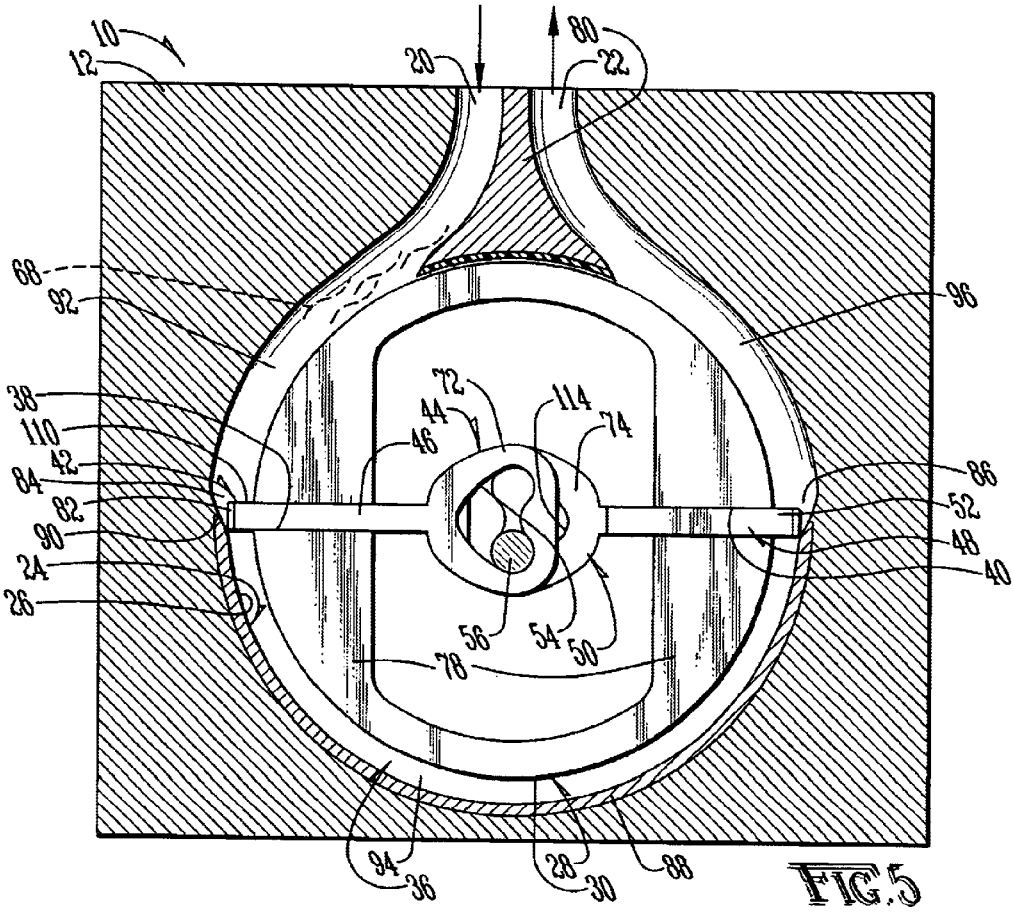
FIG. 5 illustrates a rear elevation cross-section of the motor taken along line 5—5 of FIG. 1, showing the first vane at the beginning of the push stroke.

As shown in FIG. 5, the inner drum (28) is located concentrically within the outer race (26). The inner drum (28) is also provided with an added thickness (78) around the first aperture (38) and second aperture (40) to provide additional support. Secured to the casing (12), and extending into the interior defined by the outer race (26), is a stainless steel cap (80). As shown in FIG. 5, the cap (80) is provided with a width end curvature, and is supported within adequate distance of the inner drum (28) to substantially prevent the undesired backflow of fluid (68) from the fluid inlet (20), directly to the fluid outlet (22) between the cap (80) and inner drum (28).

If desired, the cap (80) may be provided with Teflon® or other similarly low friction material or, alternatively, may be provided with titanium or similar abrasion resistant material. In the preferred embodiment, the cap (80) is positioned within five millimeters of and, more preferably, within one millimeter of the inner race (30). The cap (80) is preferably positioned no closer than 1/100th of a millimeter from the inner drum (28) and, more preferably, positioned no closer than 1/10th of a millimeter from the inner drum (28) to reduce wear on tips (82) of the vane assemblies (42) and (48) and the surface of the inner drum (28). Additionally, the tips (82) of the vanes (46) and (52) may be titanium or other similarly abrasion resistant material, and may be welded or otherwise secured to the vanes (46) and (52).

As shown in FIG. 5, the casing (12) defines a constriction (84), narrowing the distance between the outer race (26) and inner drum (28) to a distance only slightly greater than the extension of the vanes (46) and (52) from the inner drum (28). Similarly, the casing (12) defines an expansion (86) approximately 180 degrees from the constriction (84) along the outer race (26).

As shown in FIG. 5, the outer race (26) is provided with an abrasion plate (88), preferably constructed of titanium or similar abrasion resistant material. As shown, the casing (12) is provided with a pair of slots (90) into which the ends of the abrasion plate (88) are friction fit. Accordingly, as shown in FIG. 5, the casing (12) and outer race (26) define a wide fluid intake chamber (92), a narrow fluid push chamber (94) and a wide fluid exhaust chamber (96).

Any suitable source may be used to produce the pressurized fluid (68) to operate the motor (10), including any suitable gas or liquid known in the art. In the preferred embodiment, the pressurized fluid (68) is steam, generated by a heater (98). The heater (98) heats a heating chamber (100) provided with water (102). The heating chamber (100) is coupled by a pressure hose (104) to the inlet (20). Similarly, the outlet (22) is coupled to a return hose (106) which, in turn, is coupled to a condenser (108) in fluid communication with the heating chamber (100). To operate the motor (10) of the present invention, the heater (98) is engaged to provide sufficient heat to the heating chamber (100) to vaporize the water (102) and move the resulting pressurized fluid (68) through the pressure hose (104) into the inlet (20) of the casing (12). (FIGS. 1 and 5).

Figure 6:
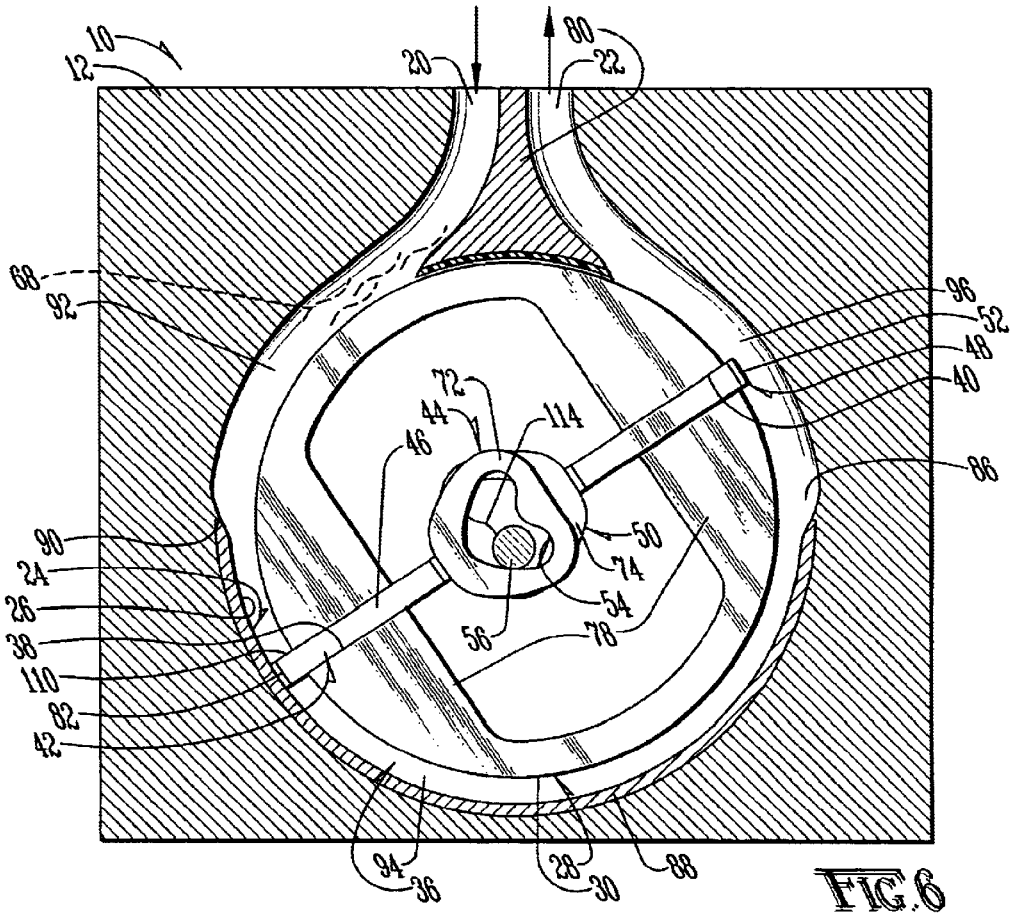
FIG. 6 illustrates a rear elevation cross-section of the motor of FIG. 5, showing the first vane partially through the push stroke.

From the inlet (20), the pressurized fluid (68) enters the fluid intake chamber (92). As the pressurized fluid (68) enters the fluid intake chamber (92), the pressurized fluid (68) presses against a face (110) of the first vane (46). As the pressurized fluid (68) continues to press against the face (110), the force rotates the first vane (46) and inner drum (28) to the orientation shown in FIG. 6. As shown in FIG. 6, as the inner drum (28) rotates, the configuration of the heart-shaped slot (54) maintains the first vane (46) at a constant relationship to the abrasion plate (88). In the preferred embodiment, the gap between the tip (82) of the first vane (46) and the abrasion plate (88) is less than five millimeters and, more preferably, less than one millimeter, while being preferably greater than 1/100 of a millimeter and, more preferably, more than 1/50 of a millimeter.

Figure 7:
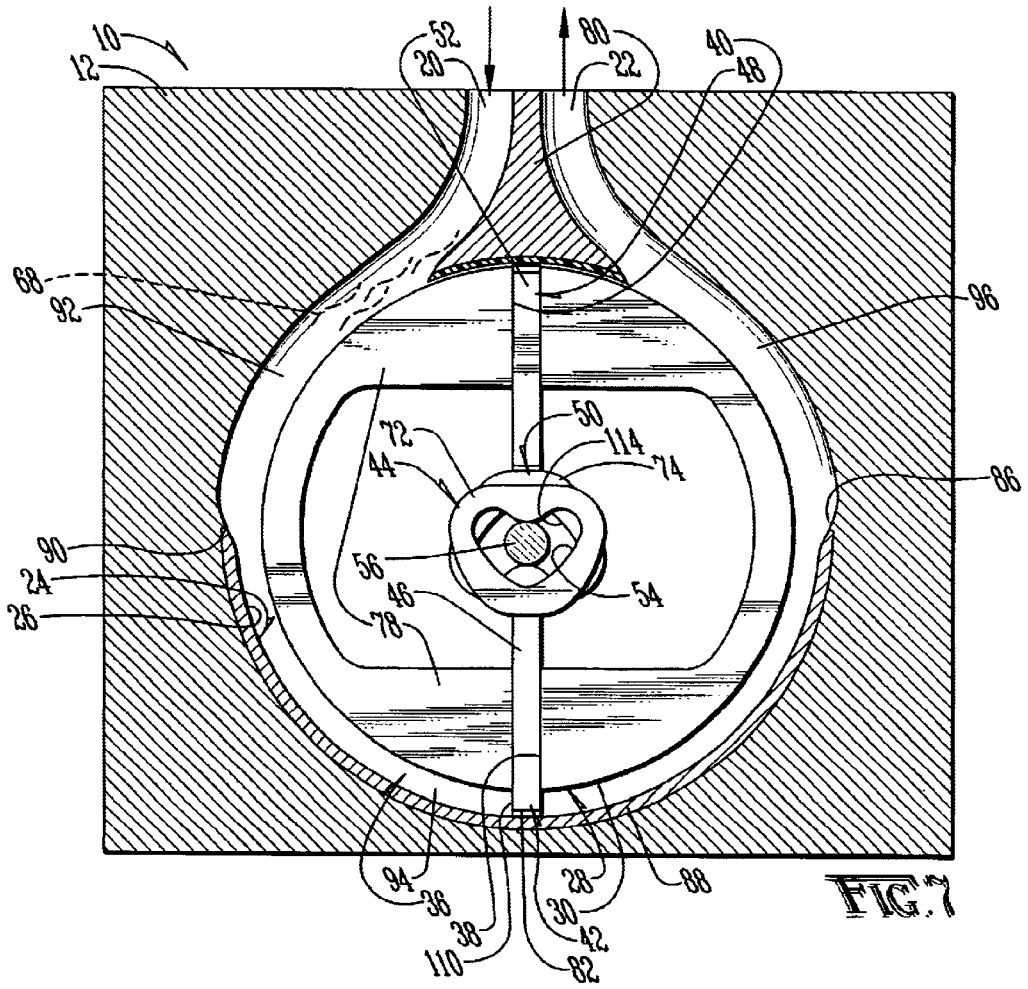
FIG. 7 illustrates a rear elevation cross-section of the motor of FIG. 5, showing the first vane at the mid-point of the push stroke.

By maintaining the gap between the inner drum (28) and abrasion plate (88) constant, while maintaining the orientation of the first vane (46) relative to the abrasion plate (88) constant as well, undesirable vacuum forces can be substantially reduced, thereby increasing the efficiency of the motor. As the pressurized fluid (68) continues to press against the face (110) of the first vane (46), the first vane (46) rotates to the orientation shown in FIG. 6. As shown in FIG. 7, in this position the drum shaft (56) coacts with the heart-shaped slot (54) to maintain the first vane (46) at the predetermined relationship relative to the abrasion plate (88), while the heart-shaped slot (114) of the second vane (52) coacts with the drum shaft (56) to fully retract the second vane (52) within the inner drum (28) to allow the second vane (52) to clear the cap (80) and eliminate any back pressure applied to the second vane (52) from the pressurized fluid (68).

Figure 8:
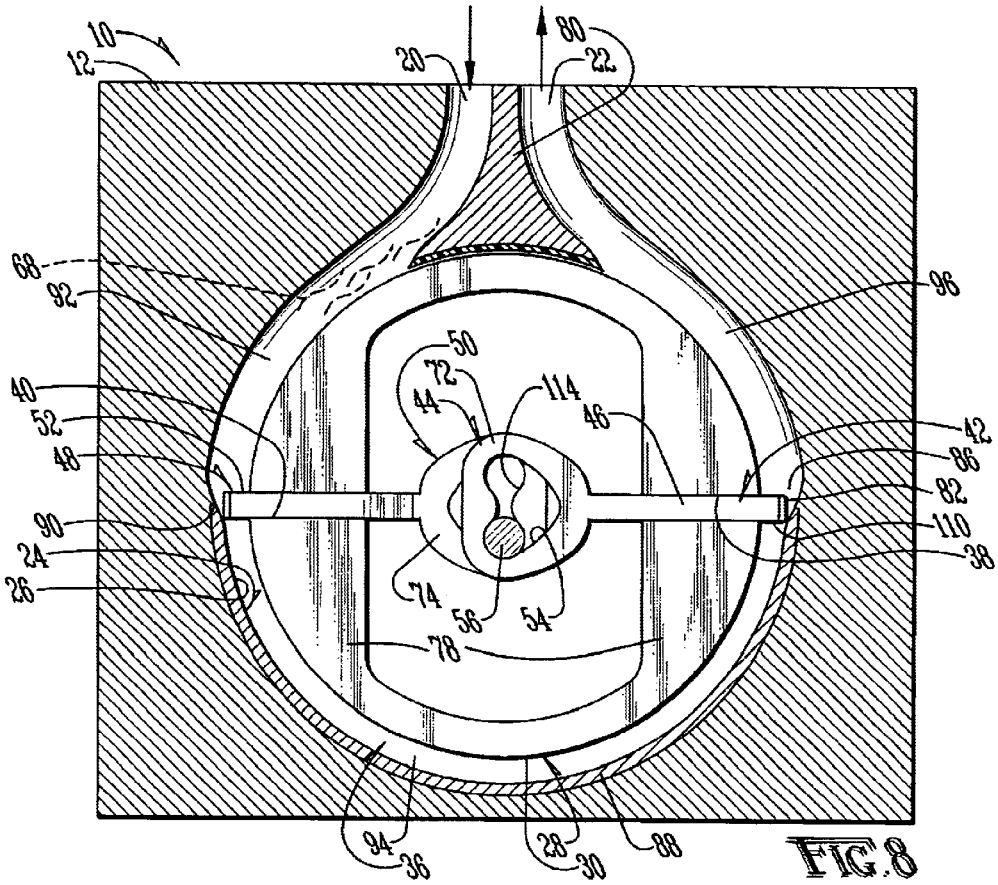
FIG. 8 illustrates a rear elevation cross-section of the motor of FIG. 5, showing the vane finishing the push stroke.
Figure 9:
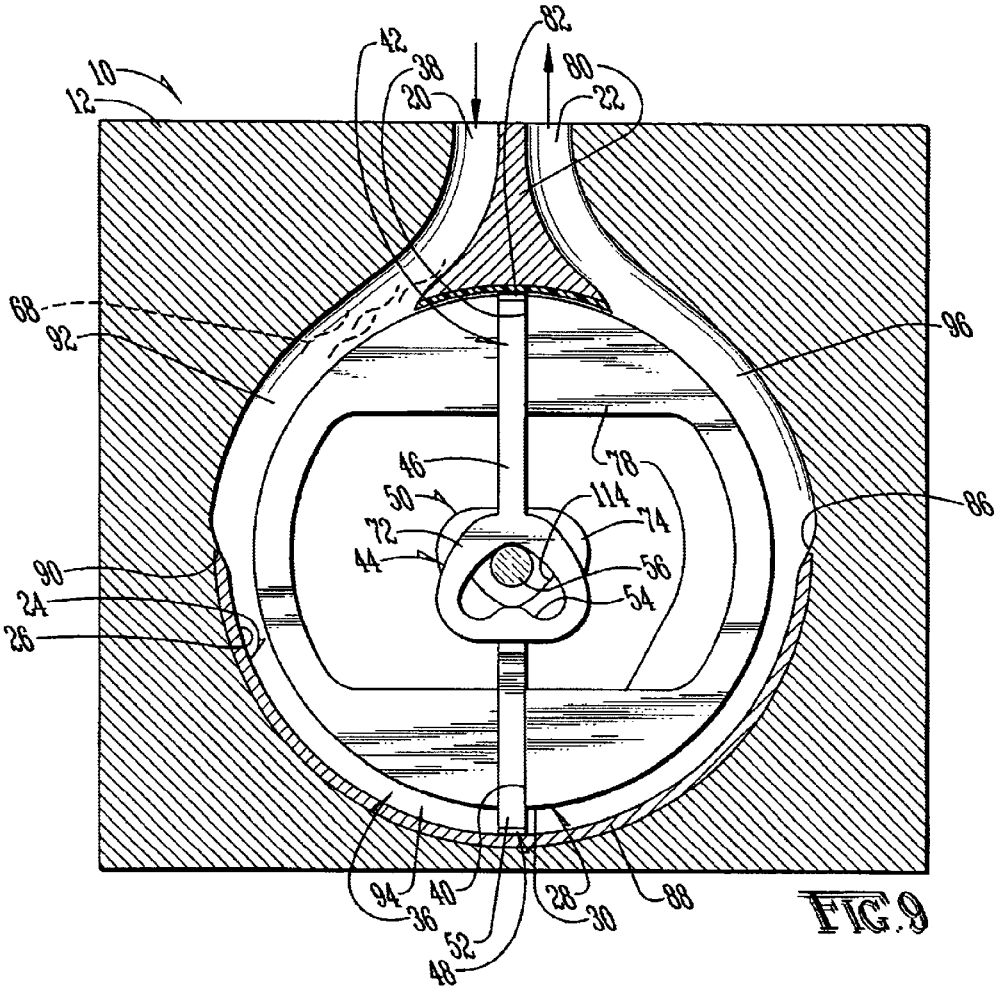
FIG. 9 illustrates a rear elevation cross-section of the motor of FIG. 5, showing the vane at maximum retraction.

As the pressurized fluid (68) continues to push the first vane (46) toward the orientation shown in FIG. 8, the heart-shaped slot (114) of the second vane (52) coacts with the drum shaft (56) to extend the second vane (52) toward the predetermined orientation relative to the abrasion plate (88). From this orientation, the additional pressure of the fluid (68) begins to act on the face (116) of the second vane (52) to continue the process. As the pressurized fluid (68) continues to push, the second vane (52) rotates the inner drum (28) to the position shown in FIG. 9, maintaining the orientation of the second vane (52) relative to the abrasion plate (88), and fully retracting the first vane (46) to allow the first vane (46) to pass under the cap (80). Once the pressurized fluid (68) reaches the expansion (86), the pressurized fluid (68) passes by the vanes (46) and (52) to exit through the fluid outlet chamber (96). As shown in FIG. 1, once the pressurized fluid (68) exits the fluid outlet chamber (96) through the fluid outlet (22), the pressurized fluid (68) moves into the heating chamber (100) as water (102). From the heating chamber (100), the heater (98) heats the water (102), converting the water (102) into the pressurized fluid (68) to continue the process.

Figure 10:
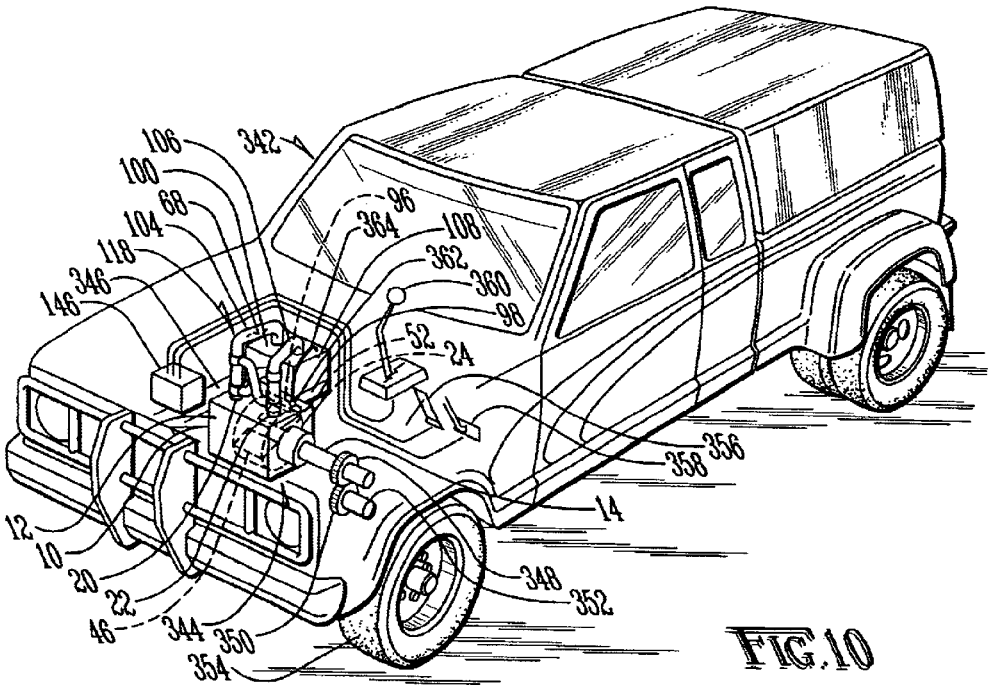
FIG. 10 illustrates a side perspective view in partial cutaway of a truck incorporating the motor of the present invention.

As shown in FIG. 10, the motor (10) may be used in association with a motor vehicle (342). The motor (10) is preferably positioned within the engine compartment (344) and secured to the frame (346) of the motor vehicle (342) by bolts (not shown), or by any manner such as those well known in the art. As shown, the drive shaft (14) is provided with a gear (348) operably coupled to another gear (350) secured to an axle (352). The axle (352), in turn, is connected to a pair of wheels (354) used to motivate the motor vehicle (342). One advantage of the motor (10) of the present invention is the efficient production of torque over a wide range of speeds. Accordingly, there is no need for a transmission such as that used in the prior art. Similarly, a computer controlled switching system (146) coupled to a plurality of vales (118) is capable of reversing the flow of pressurized fluid (68) through the motor (10). This construction eliminates the need for a reverse gear such as that used in the prior art. By eliminating the transmission and reverse gear, wear and maintenance of these parts is eliminated.

As shown in FIG. 10, the motor vehicle (342) is provided with an accelerator (356), a brake (358) and a reverse lever (360). The accelerator (356), brake (358) and reverse lever (360) are all electrically coupled to the computer controlled switching system (146). Of course, the accelerator (356), brake (358) and reverse lever (360) may be hydraulically, pneumatically or otherwise coupled to the computer controlled switching system (146). In operation, when it is desired to motivate the motor vehicle (342) a user depresses the accelerator (356) which signals the computer controlled switching system (146) to actuate the plurality of vales (118) to allow pressurized fluid (68) to flow through the pressure hose (104), through the inlet (20), rotate the vanes (46) and (52) of the motor (10) and exit through the outlet (22), through the return hose (106), and return to the condenser (108) and heating chamber (100), where the water (102) is reheated by the heater (98).

When it is desired to slow the motor vehicle (342), the brake (358) is depressed, thereby signaling the computer controlled switching system (146) to close the plurality of vales (118). With the plurality of vales (118) closed, the wheels (354) of the motor vehicle (342) continue to rotate the axle (352), the gear (350), the gear (348), the drive shaft (14) and the vanes (46) and (52). As the vanes (46) and (52) continue to rotate, they continue to motivate and compress the pressurized fluid (68) contained within the hollow interior (24) of the motor (10) within the fluid outlet chamber (96). As the vanes (46) and (52) continue to rotate, the pressure of the pressurized fluid (68) within the fluid outlet chamber (96) continues to build and the temperature of the pressurized fluid (68) increases. As shown in FIG. 10, the casing (12) is provided with a blow off valve (362) in fluid communication with the fluid outlet chamber (96). The blow off valve (362) may, of course, be set at any desired temperature or pressure. Once this pressure is attained, the blow off valve (362) opens up communication of the fluid outlet chamber (96) with an overflow hose (364) to return the pressurized fluid (68) directly to the heating chamber (100). In this manner, energy is returned to the system by using rotation of the wheels (354) to motivate the vanes (46) and (52), and heat and pressurize the pressurized fluid (68) in the motor (10). Additionally, during braking, the computer controlled switching system (146) may be used to actuate the plurality of vales (118) to allow pressurized fluid (68) to pass from the pressure hose (104) through the plurality of vales (118) directly into the fluid outlet chamber (96), to provide a back pressure into the hollow interior (24) of the motor (10). This back pressure operates to flow the rotation of the vanes (46) and (52) and, in turn, the wheels (354) of the motor vehicle (342) more quickly, and provides a larger volume of pressurized fluid (68) to pressurize and heat, and return through the blow off valve (362) and overflow hose (364) to the heating chamber (100). This provides added braking force, and increased volume of pressurized fluid (68) to heat and pressurize during the braking operation.

If it is desired to reverse the motor vehicle (342), the reverse lever (360) is actuated, thereby signaling the computer controlled switching system (146) to actuate the plurality of vales (118) to reverse the flow of pressurized fluid (68) through the hollow interior (24) of the motor. When the reverse lever (360) is actuated, the pressurized fluid (68) passes through the pressure hose (104) through the plurality of vales (118) through the outlet (22) into the fluid outlet chamber (96). The pressurized fluid (68) passes through the hollow interior (24), out through the inlet (20) back to the plurality of vales (118). From the plurality of vales (118), the pressurized fluid (68) returns through the return hose (106) to the condenser (108). By reversing the flow of pressurized fluid (68) through the hollow interior (24), the vanes (46) and (52) rotate the drive shaft (14) in a reverse direction which, in turn, rotates the gear (44) and gear (50) in a reverse direction, thereby rotating the axle (352) and wheel (354) in a reverse direction as well. If desired, the reverse lever (360) may be used as an alternative to the brake (358) to provide the most braking assist to the motor vehicle (342). Accordingly, not only does this assembly reduce the need for high wear pads or shoes in a braking system, but also extracts energy from the braking process and returns the energy to the heating chamber (100) in the form of pressurized fluid (68) having increased heat and/or pressure.

Figure 11:
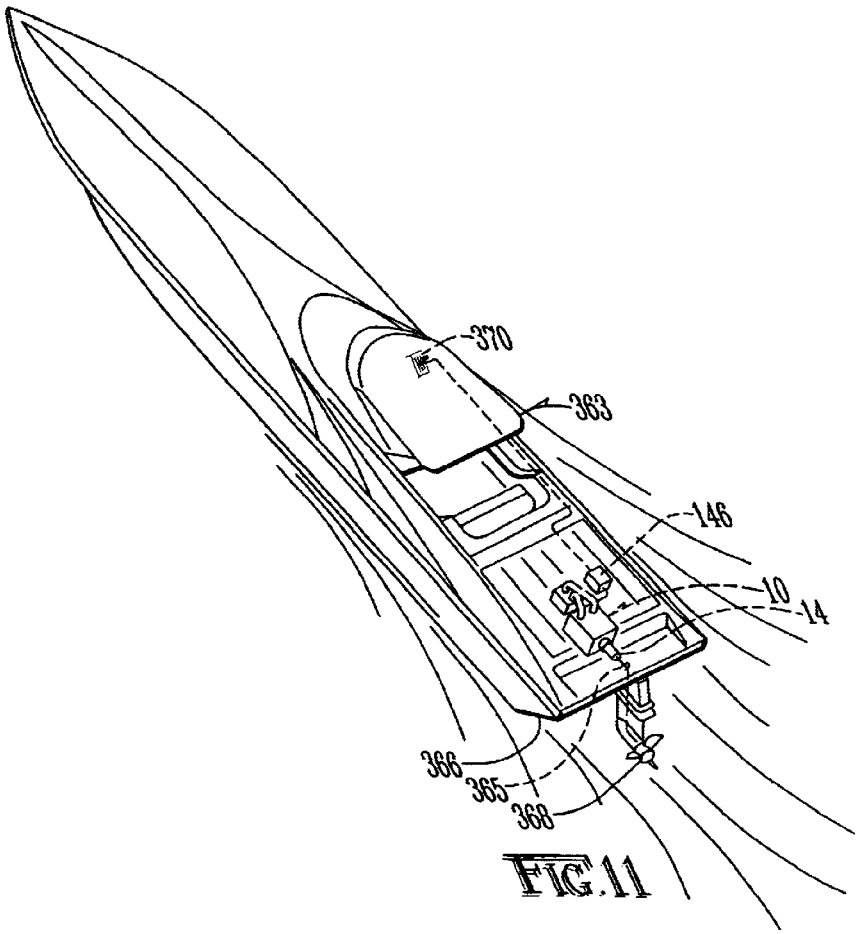
FIG. 11 illustrates a side perspective view in partial cutaway of a watercraft incorporating the motor of the present invention.

As shown in FIG. 11, the motor (10) may be used in association with large or small watercraft (363). In this adaptation of the motor (10), the drive shaft (14) extends through an aperture (365) provided in the stern (366) of the watercraft (363). The drive shaft (14) is secured to a propeller (368) such as those well known in the art. In this application as well, the computer controlled switching system (146) is coupled to a throttle lever (370). When the throttle lever (370) is pulled toward the stern (366) of the watercraft (363), the computer controlled switching system (146) reverses the flow of pressurized fluid (68) through the motor (10), thereby providing braking and reversing the watercraft (363). Pulling the throttle lever toward the stern (366) reverses the rotation of the propeller (368), thereby eliminating the need for a separate reverse gear. Also, as the motor produces efficient torque over a wide range of speeds, there is no need for a prior art transmission. It should be noted that the motor (10) may be used in watercraft ranging from personal watercraft to large ships, with the motor (10) being sized and constructed to accommodate such diverse applications.

Figure 12:
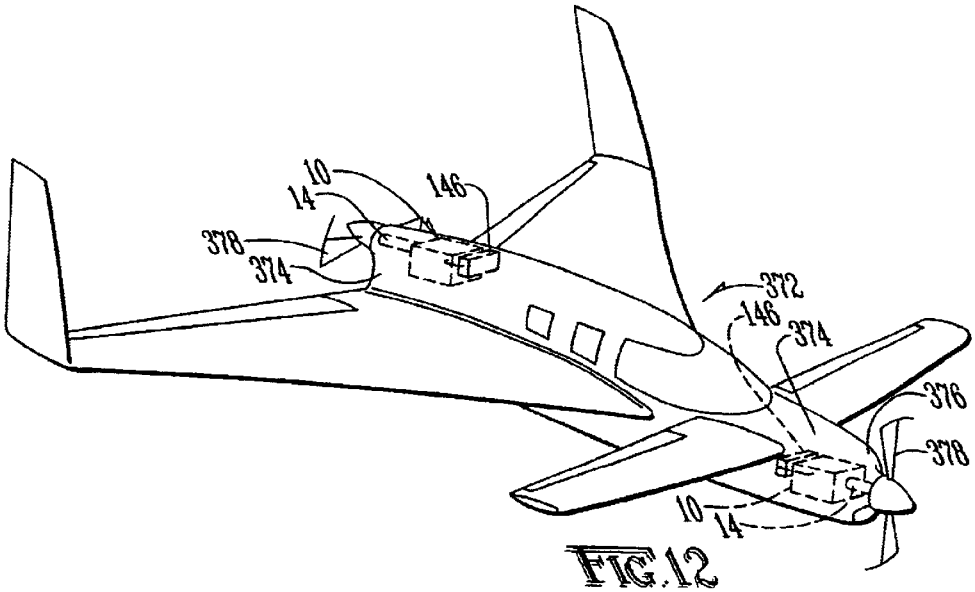
FIG. 12 illustrates a top perspective view in partial cutaway of a propeller driven aircraft incorporating the motor of the present invention.

As shown in FIG. 12, the motor (10) is adaptable for use in a propeller driven aircraft (372). The motor (10) is preferably provided within the engine compartment (374) of the propeller driven aircraft (372), with the drive shaft (14) extending through the front (376) of the propeller driven aircraft (372). The drive shaft (14) is coupled directly to a propeller (378) without the need for intermediate gearing or a transmission. The computer controlled switching system (146) is coupled directly to the motor (10) to allow reversing of the propeller (378) for use when the propeller driven aircraft (372) is on the ground. As an alternative, a motor (10) can provided with the drive shaft (14) extending through the rear of the propeller driven aircraft (372) as shown in FIG. 12.

Figure 13:
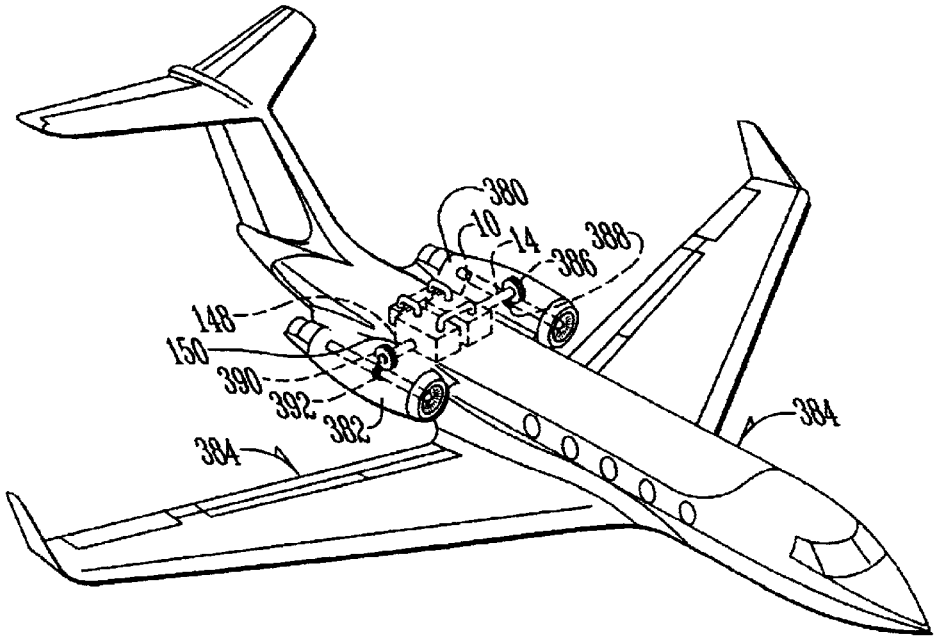
FIG. 13 illustrates a top perspective view in partial cutaway of a turbine driven aircraft incorporating the motor of the present invention.

In yet another application of the motor (10) of the present invention, as shown in FIG. 13, the motor (10) may be used in conjunction with an auxiliary motor (148) to drive the first turbine (380) and a second turbine (382) of a turbine driven aircraft (384). In the preferred embodiment, the drive shaft (14) of the motor (10) is provided with a large gear (386) which is coupled to a smaller gear (388) which, in turn, is coupled to the first turbine (380) in a manner such as that known in the art. Similarly, an auxiliary drive shaft (150) of the auxiliary motor (148) is provided with a large gear (390) which, in turn, is coupled to a smaller gear (392), coupled to the second turbine (382) in a manner such as that known in the art.

Figure 14:
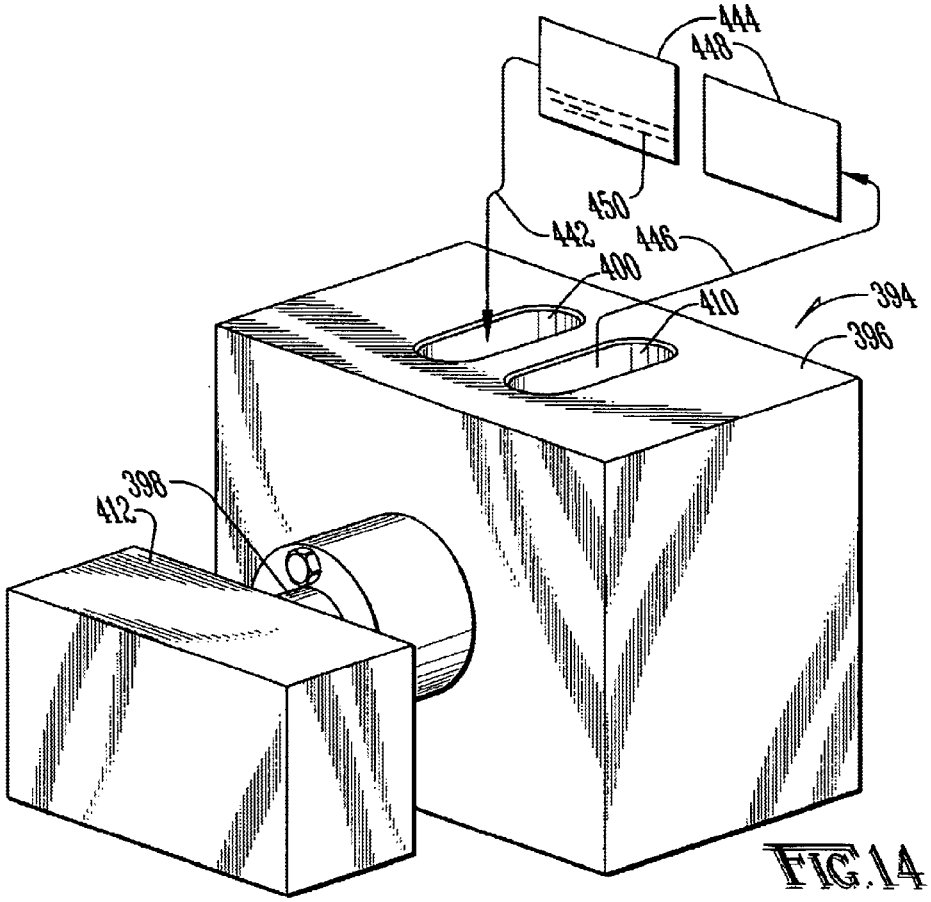
FIG. 14 illustrates a front perspective view of an alternative embodiment of the present invention, utilizing the vane motor as a fluid pump.

In yet another alternative embodiment of the present invention, a pump (394) is provided with a casing (396), a drive shaft (398), an inlet (400) and an outlet (410). (FIG. 14). The drive shaft (398) is coupled to a rotational motion generator (412) such as a gasoline engine, a diesel engine, an electric engine, or other rotational motion generator such as those known in the art.

As shown in FIG. 14, the casing (396) defines an outer race (414) within which is provided an inner drum (416). The inner drum (416) is provided with a first vane assembly (418), including a first vane (420), a first block (422), defining a first heart-shaped slot (424) around a drum shaft (426). A second vane assembly (428) is provided with a second vane (430), coupled to a second block (432), defining a second heart-shaped slot (434), also provided around the drum shaft (426). The first vane assembly (418) and second vane assembly (428) are provided within the inner drum (416) and around the drum shaft (426) in a manner such as that described above in relationship to the motor (10).

Figure 15:
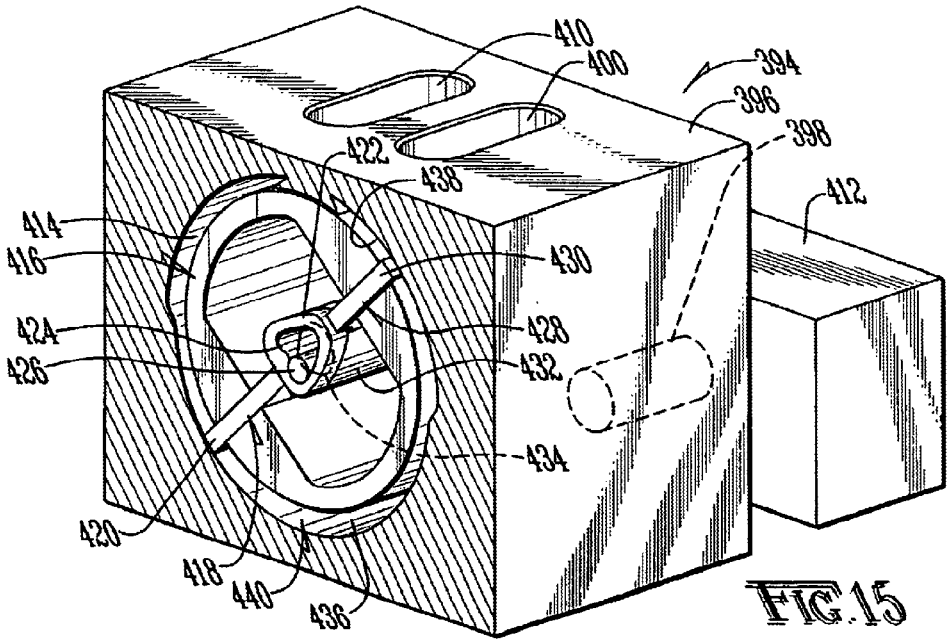
FIG. 15 illustrates a rear perspective view of the alternative embodiment shown in FIG. 13, shown with the rear of the case and bushing removed.

The outer race (414) includes an arcuate center surface (436) and a ceiling (438). Together the outer race (414) and inner drum (416) define a hollow interior (440) of the pump (394). (FIG. 15). As shown in FIG. 14, a suction hose (442) is coupled on one end to the inlet (400) and provided with its other end in a fluid supply (444), such as a fluid spill or container to which it is desired to apply a vacuum. Coupled to the outlet (410) is an exhaust hose (446) which, in turn, is provided into communication with a receptacle (448), such as a barrel, drum or drain. When it is desired to operate the pump (394), the rotational energy generator (412) is operated to rotate the drive shaft (398). As the drive shaft (398) rotates, the inner drum (416) revolves, causing the vane assemblies (418) and (428) to alternatively extend and retract relative to the inner drum (416), as described above, to generate a vacuum within the hollow interior (440) and draw fluid (450), such as water or gas, from the fluid supply (444) through the suction hose (442). (FIGS. 14–15). Upon entering the casing (396), the fluid (450) is driven by the vanes (420) and (430) out of the outlet (410) through the exhaust hose (446) and into the receptacle (448). If it is desired to move the fluid (450) from the receptacle (448) to the fluid supply (444), the rotational energy generator (412) is simply reversed, thereby causing the vanes (420) and (430) to reverse their motion and drive the fluid in a reverse direction through the hollow interior (440) of the pump (394) and back out through the suction hose (442).

Although the invention has been described with respect to a preferred embodiment thereof, it is to be also understood that it is not to be so limited since changes and modifications can be made therein which are within the full, intended scope of this invention as defined by the appended claims. For example, it should be noted that the motor may be constructed of any suitable size, ranging in size from less than one millimeter to several meters in diameter. It is also anticipated that any suitable pressurized fluid, such as pressurized air, pressurized water, pressurized silicon, or any liquid or gas may be used to rotate the vanes (46) and (52).

What is claimed is:

1. A motor comprising:

(a) an outer race;

(b) an inner race provided within said outer race;

(c) means coupled to said inner race for centering said inner race on a first axis as said inner race rotates;

(d) a shaft provided a long a second axis, wherein said second axis is different than said first axis;

(e) a vane coupled to said shaft;

(f) an end provided on said vane; and (g) means coupled to said vane for moving said end arcuately relative to said shaft.

2. The motor of claim 1, wherein said inner race defines an opening through which said vane extends.

3. The motor of claim 1, wherein said end moving means is a block coupled to said vane, said block being provided with an arcuate slot through which extends said shaft.

4. The motor of claim 3, wherein said slot is convex relative to said end of said vane.

5. The motor of claim 1, further comprising:

(a) a supplemental vane coupled to said shaft;

(b) a supplemental end provided on said supplemental vane; and (c) means coupled to said supplemental vane for moving said supplemental end arcuately relative to said supplemental shaft.

6. The motor of claim 5, wherein said inner race defines a first opening through which said vane extends, and a second opening through which said second van extends.

7. The motor of claim 5, wherein said supplemental end moving means is a supplemental block coupled to said supplemental vane, said supplemental block being provided with a supplemental arcuate slot through which extends said shaft.

8. The motor of claim 7, wherein said slot is convex relative to said end of said vane and wherein said supplemental slot is convex relative to said supplemental end of said supplemental vane.

9. The motor of claim 1, wherein said outer race defines a fluid inlet and a fluid outlet, wherein said fluid inlet is provided on said outer race no less than about ninety degrees from said fluid inlet.

10. The motor of claim 9, further comprising a block positioned between said fluid inlet and said fluid outlet, close enough to said inner race to substantially reduce the passage of fluid therebetween.

11. The motor of claim 1, wherein said moving means is means for moving said end sufficiently close to said outer race, so as to substantially reduce the passage of fluid between said vane and said outer race, throughout at least ninety degrees of rotation of said inner race relative to said outer race.

12. The motor of claim 1, wherein the motor is drivably coupled to a wheel of a motor vehicle.

13. The motor of claim 1, wherein the motor is drivably coupled to a propeller.

14. The motor of claim 1, wherein the motor is drivably coupled to a turbine of an aircraft.

15. A motor comprising:

(a) an outer race;

(b) an inner race provided within said outer race, said inner race defining a first slot and a second slot;

(c) means coupled to said inner race for centering said inner race on a first axis as said inner race rotates;

(d) a shaft provided along a second axis, wherein said second axis is different than said first axis;

(e) a first vane having a first end provided through said first slot and coupled to said shaft;

(f) a second vane having a second end provided through said second slot and coupled to said shaft;

(g) wherein said first vane and said second vane are angled greater than ninety degrees from one another; and (h) means coupled to said first vane and said second vane for substantially extending and retracting said first vane and said second vane in unison relative to said shaft.

16. The motor of claim 15, wherein said moving means comprises:

(a) a first block coupled to said first vane, said first block being provided with a first arcuate slot through which extends said shaft; and (b) a second block coupled to said second vane, said second block being provided with a second arcuate slot through which extends said shaft.

17. The motor of claim 16, wherein said first arcuate slot is convex relative to said first vane, and wherein said second arcuate slot is convex relative to said second vane.

18. The motor of claim 15, wherein said outer race defines a fluid inlet and a fluid outlet, wherein said fluid inlet is provided on said outer race no less than about ninety degrees from said fluid inlet.

19. The motor of claim 15, further comprising a block positioned between said fluid inlet and said fluid outlet, close enough to said inner race to substantially reduce the passage of fluid therebetween.

20. A motor comprising:

(a) an outer race;

(b) an inner race provided within said outer race;

(c) means coupled to said inner race for centering said inner race on a first axis as said inner race rotates;

(d) a shaft provided a long a second axis, wherein said second axis is different than said first axis;

(e) wherein said inner race defines a first slot and a second slot approximately one hundred and eighty degrees from another, along a surface of said inner race;

(f) a first vane provided through said first slot;

(g) a first block coupled to said first vane, said first block defining a first arcuate slot through which is provided said shaft;

(h) a second block coupled to said second vane, said second block defining a second arcuate slot through which is provided said shaft;

(i) said inner race and said outer race defining interstice of a substantially constant separation along at least one hundred and fifty degrees of an interior surface of said outer race; and (j) said inner race and said outer race defining a space therebetween greater than interstice collectively along at least forty degrees of said interior surface of said outer race.

21. The motor of claim 20, wherein said first arcuate slot is convex relative to said first vane, and wherein said second arcuate slot is convex relative to said second vane.

22. The motor of claim 20, wherein said outer race defines a fluid inlet and a fluid outlet, wherein said fluid inlet is provided on said outer race no less than about ninety degrees from said fluid outlet.

23. The motor of claim 20, further comprising a block positioned between said fluid inlet and said fluid outlet close enough to said inner race to substantially prevent the passage of fluid therebetween.

* * * * *